US009113769B2

(12) United States Patent
Nikjoo et al.

(10) Patent No.: US 9,113,769 B2
(45) Date of Patent: Aug. 25, 2015

(54) REVOLVING CLOTH MOP

(71) Applicants: Paymon Nikjoo, Granada Hills, CA (US); Sara Nikjoo, Granada Hills, CA (US)

(72) Inventors: Paymon Nikjoo, Granada Hills, CA (US); Sara Nikjoo, Granada Hills, CA (US)

( * ) Notice: Subject to any disclaimer, the term of this patent is extended or adjusted under 35 U.S.C. 154(b) by 0 days.

(21) Appl. No.: 14/105,140

(22) Filed: Dec. 12, 2013

(65) Prior Publication Data

US 2015/0164296 A1 Jun. 18, 2015

(51) Int. Cl.
*A47L 13/20* (2006.01)
*A47L 13/24* (2006.01)

(52) U.S. Cl.
CPC *A47L 13/20* (2013.01); *A47L 13/24* (2013.01)

(58) Field of Classification Search
CPC ..... A47L 13/20; A47L 13/24
USPC ..... 15/147.1, 147.2, 228
See application file for complete search history.

(56) References Cited

U.S. PATENT DOCUMENTS 5,165,138 A * 11/1992 Garabedian ..... 15/247

* cited by examiner

*Primary Examiner* — Randall Chin

(57) ABSTRACT

A surface cleaning device, such as a mop, which includes a T-frame, a cleaning cloth, a piece of string and two hooks as its basic components, is provided. The T-frame is comprised of a handle and a shoe. The string passes through a hole near the top of the handle and is attach to the ends of the cloth by two hooks, pulling the cloth tightly against the shoe. One section of the cloth is under the shoe, and in contact with the floor, at a time. Once this section is soiled, it is replaced with an adjacent clean section of the cloth by pulling the string. A roller is provided to make pulling the string easier. When the entire cloth is soiled, it can be unhooked to be washed or replaced.

5 Claims, 5 Drawing Sheets

REVOLVING CLOTH MOP

BACKGROUND OF THE INVENTION

1. Field of the Invention

Surface cleaning devices and mops.

2. Prior Arts

Existing mops which utilize cloth to clean smooth floors and surfaces bring the entire cloth in contact with the floor at the same time. As a result, the entire cloth becomes soiled at the same time. If a clean cloth is desired for the next section of the floor, the entire cloth must either be washed or replaced. If the mop is used with a wet cloth, to dry the floor quickly, another dry cloth is required.

In this design, only one section of the cloth is in contact with the floor at a time. When this section gets soiled, it can be replaced with a clean section of the same cloth by turning a roller, or by pulling the string. Different sections of the same cloth can be used wet or dry and if one section is used wet a dry section can be pulled under the shoe to quickly dry the floor.

BRIEF SUMMARY OF THE INVENTION

A surface cleaning device, such as a mop, which includes a T-frame, a cleaning cloth, a piece of string and two hooks as its basic components, is provided. The T-frame is comprised of a handle and a shoe. The string passes through a hole near the top of the handle and is attach to the ends of the cloth by two hooks, pulling the cloth tightly against the shoe. One section of the cloth is under the shoe, and in contact with the floor, at a time. Once this section is soiled, it is replaced with an adjacent clean section of the cloth by pulling the string. A roller is provided to make pulling the string easier. When the entire cloth is soiled, it can be unhooked to be washed or replaced.

The advantages of this invention are:

- Easy replacement of the soiled section of the cloth with a clean section, by pulling a string or turning a roller.
- Different sections of the same cloth can be used, while wet or dry. A dry section of the same cloth can be used to dry the floor after wet cleaning.
- The cloth is used most efficiently, because every available section of both sides of the cloth can be used before having to wash or replace it.
- The cloth is reusable and, therefore, environmentally friendly.
- The specially designed hooks allow for easy removal and replacement of the soiled cloth, and provide adjustable tension to the cloth.

DETAILED DESCRIPTION OF THE INVENTION

A surface cleaning device which utilizes a cloth to clean smooth surfaces, such as floors, walls, ceilings, doors and table tops, is described in conjunction with the attached drawings. The device is comprised of a T-frame, a rectangular cloth, a piece of string, two special hooks, a roller and its bracket.

Figure 1:
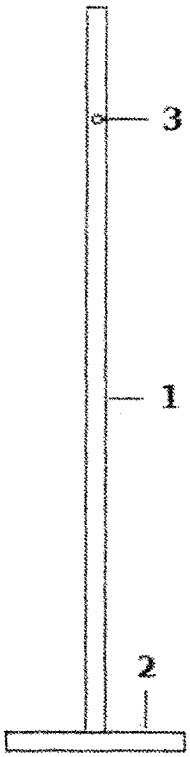
FIG. 1 shows the front view of the T-frame.

The T-frame, as shown in FIG. 1, includes a handle 1 and a shoe 2. The T-frame can be made of rigid plastic, wood, metal or a combination of these materials. The shoe 2 is shown with a circular cross section, however it can have any suitable cross section such as rectangular or triangular.

The cloth 5 can be made of terry cloth, microfiber, or other absorbent material. Two knotted strings 9, which have a few knots at equal distances along their lengths, are permanently attached to the opposite ends of the cloth 5.

Figure 2:
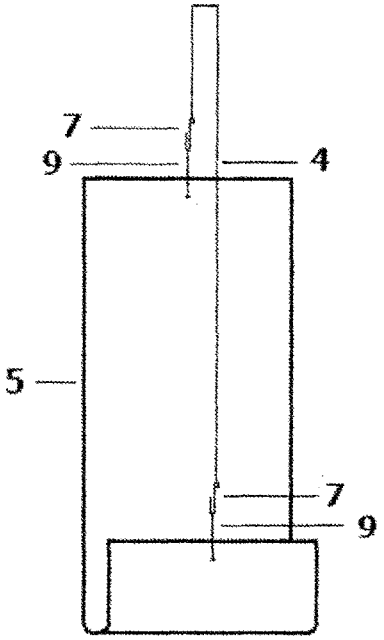
FIG. 2 shows the loop formed by the cloth and the string.
Figure 3:
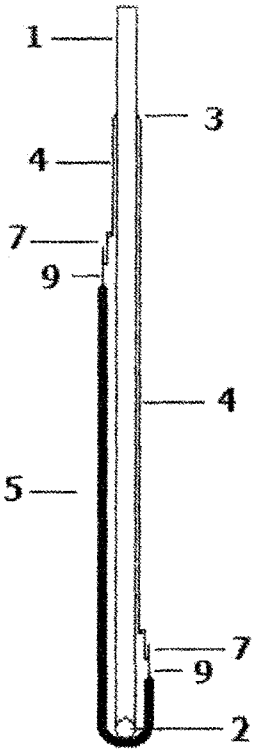
FIG. 3 shows the side view of the T-frame with the cloth and the string attached.

As shown in FIG. 3, the string 4 passes through the hole 3, near the top of the handle 1, and is connected to the opposite ends of the cloth 5 through the combination of the hooks 7 and knotted strings 9. This allows the cloth 5 to be supported by the frame and be pulled tightly against the shoe 2. FIG. 2 shows the basic loop formed between the cloth 5 and the string 4 with the T-frame eliminated for clarity.

Figure 4:
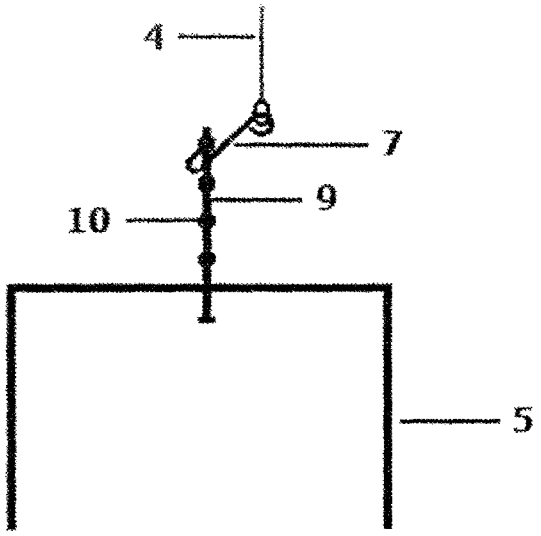
FIG. 4 shows the connection between the string and the cloth.
Figure 5:
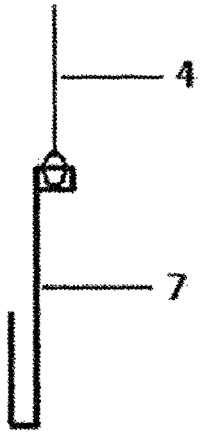
FIG. 5 shows the special hook used to adjust the tension of the cloth.

FIG. 5 shows the special hook 7, made of steel, which has a narrow slot that can engage and grab any of the knots 10 on the knotted string 9. FIG. 4 shows the special hook 7 grabbing one of the knots of the knotted string 9. By engaging the hooks with different knots the tension of the cloth 5 can be adjusted. A small chain can be used instead of the knotted string 9.

During the cleaning process, the section of the cloth 5 under the shoe 2 is pushed over a smooth surface. When this section of the cloth is soiled, it can be replaced with the adjacent clean section by pulling the string 4. Different or consecutive sections of the same cloth can be used while wet or dry. For wet application, the floor, or the section of the cloth 5 under the shoe 2, can be sprayed with water, soap, or other cleaners. To dry the wet floor, the string 4 is pulled and a dry section of the cloth 5 replaces the previous wet section.

Figure 8:
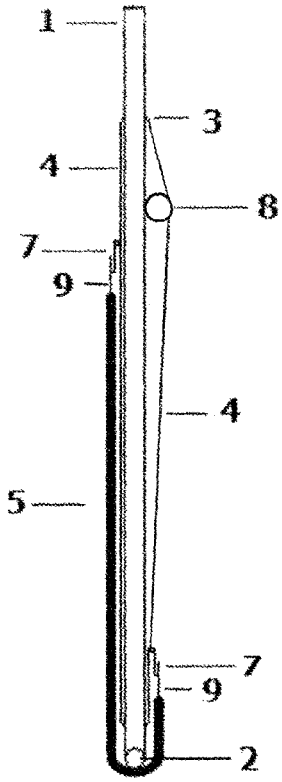
FIG. 8 shows the side view of the T-frame with the roller, string, and the cloth attached.
Figure 9:
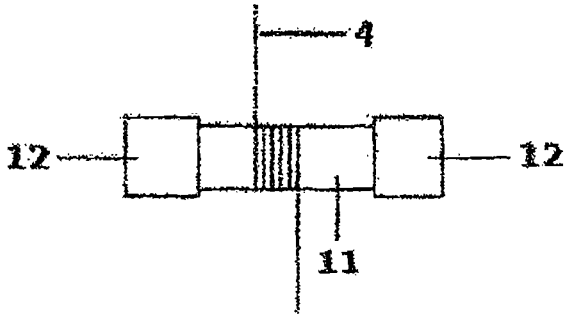
FIG. 9 shows the roller with the string wrapped around it.

The string 4 can be pulled manually or by using a roller or a lever. A roller 8, with two different brackets, is designed for this device. The roller 8 is comprised of a shaft 11 and two caps 12 as shown in FIG. 9. For clarity, In FIG. 6, FIG. 7, and FIG. 8, the roller 8 is shown without a bracket. The two caps 12, as shown in FIG. 9, are used as knobs to grip while turning the roller 8, they are suitable for right or left handed operation. The roller 8 can be made of plastic, wood, metal, or other suitable material. The string 4 is wrapped around the shaft 11 five turns or more as necessary to create enough friction between the shaft and the string to be able to pull the cloth 5, by turning the roller 8.

Figure 6:
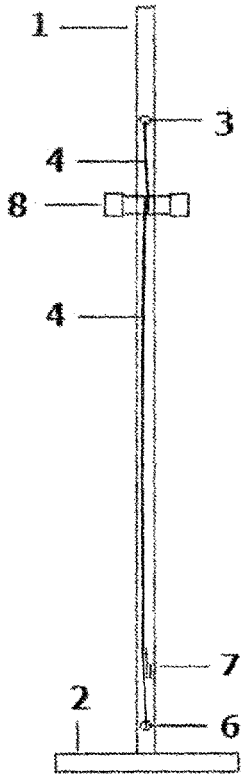
FIG. 6 shows the front view of the T-frame with the roller and the string.
Figure 7:
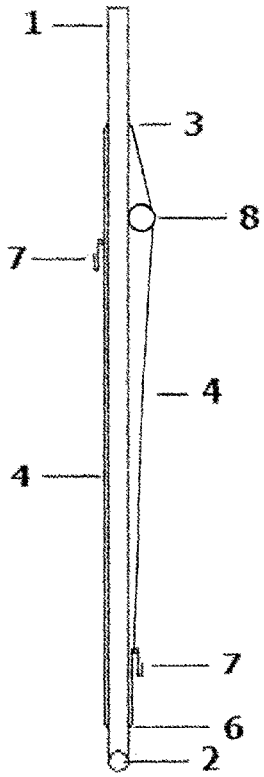
FIG. 7 shows the side view of the T-frame with the roller and the string.

To keep the hooks in place and the string from getting entangled when the cloth is removed, a closed loop is formed by the string independent of the cloth, as follows. A second hole 6 is provided in the handle 1 near the shoe 2. The string 4, which is wrapped around the shaft 11, is passed through the holes 3 and 6 and its ends are tied together forming a closed loop around the length of the handle 1. This is shown in FIG. 6, FIG. 7 and FIG. 8.

The roller 8 requires a bracket to be attached to the mop handle. This bracket must allow for both rotational and lateral movements of the roller. The lateral movement is forced by the string loops traveling along the shaft as the roller is turned. Since the string is under tension and is restricted in lateral movement, instead, it pulls the shaft through its loops and the bracket bearings. The space between the caps of the roller and the sides of the bracket must be enough to allow this lateral movement. Two brackets are designed which meet the above requirements, as follows.

Figure 10:
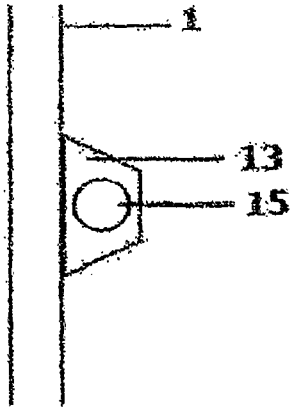
FIG. 10 shows the side view of the cylindrical bracket while connected to the handle.
Figure 11:
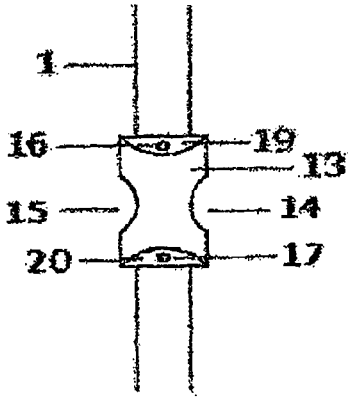
FIG. 11 shows the front view of the cylindrical bracket while connected to the handle.

Bracket 13, as shown in FIG. 10 and FIG. 11, is a hollow cylinder made of plastic, metal, or other solid material with two openings 14 and 15 at opposite ends acting as bearings for the shaft 11 and further including a top opening 19 and a bottom opening 20. The bracket 13 is attached to the handle 1 by screws 16 and 17. The shaft 11 is free to rotate and move laterally inside the openings 14 and 15, within the confines of its caps 12. The string 4, which is wrapped around the shaft 11, is free to be pulled up and down inside the hollow cylinder of the bracket 13 by turning the roller 8.

Figure 12:
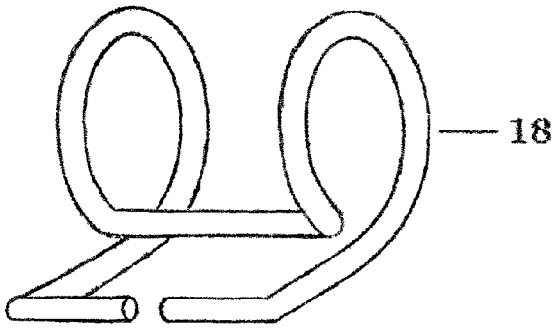
FIG. 12 shows a perspective view of the wire bracket.
Figure 13:
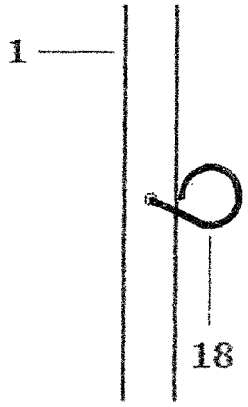
FIG. 13 shows the side view of the wire bracket while connected to the handle.
Figure 14:
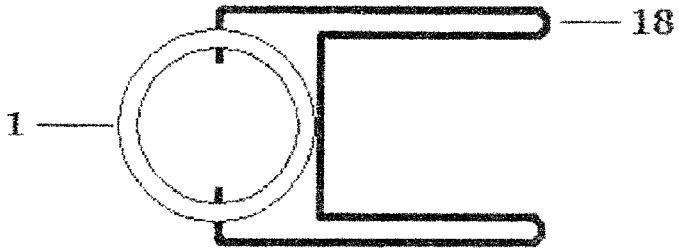
FIG. 14 shows the top view of the wire bracket while connected to the handle.

An alternative bracket 18, as shown in FIG. 12, FIG. 13, and FIG. 14, is made of steel wire and is mounted to the handle 1 by inserting its ends into opposite holes across the handle, as shown in FIG. 14. The shaft 11 is free to rotate and move laterally inside the two loops of the bracket 18, within the confines of its caps 12. The open area between the two loops allows the up and down movement of the string 4, when the roller is turned. The horizontal portion of the bracket 18 that connects the two loops together is bent away from the shaft 11 to stay clear of the string 4 that is wrapped around it.

The invention claimed is:

1. A surface cleaning device comprising: a T-frame comprised of a shoe connected to a handle, a long cloth, a string and two fasteners; a first hole is provided through the handle near the top of the handle below a hand grip of the handle perpendicular to the front view of the T-frame, wherein the string passes through the first hole, the string attached to ends of the cloth by the two fasteners, the string forming a tight loop with the cloth as the cloth passes under the shoe and contacts a surface to be cleaned, whereby when the section of the cloth under the shoe is soiled the section of the cloth under the shoe can be replaced with an adjacent clean section of the cloth by pulling the string; whereby when the entire cloth is soiled the entire cloth can be detached from the string to be washed or replaced by a new cloth; whereby in order to keep the string untangled and the fasteners in place while the cloth can be easily detached from the string a second hole is provided through the handle perpendicular to the front view of the T-frame adjacent the shoe and the string is passed through the second hole and the ends of the string are tied together so that the string forms a closed loop independent of the cloth, wherein the cloth passes under the shoe with one end of the cloth attached the string in front of the T-frame and the other end of the cloth attached to the string behind the T-frame between the first and second holes of the handle by the two fasteners; and wherein the length of the string between the two fasteners is such that any desired section of the cloth can be pulled under the shoe by pulling the string and thereby replacing any soiled section with any clean section of the cloth.

2. The surface cleaning device of claim 1 wherein each said fastener consists of a hook and a short chain with links or a knotted string with knots, the hooks being permanently connected to the string and the short chain or the knotted string being permanently connected to each end of the cloth; whereby engaging the hook with different links of the chain or different knots of the knotted string, the cloth is supported and at the same time the tension of the cloth can thereby be adjusted.

3. The surface cleaning device of claim 1 further comprising a roller that can rotate inside a bracket, the bracket being mounted to a front of the handle below the first hole of the handle, the roller is comprised of a cylindrical shaft with two caps at shaft ends, the string is wrapped around the shaft as many turns as necessary to create enough friction between the shaft and the string so that the string can be pulled by rotating the shaft, the shaft is rotated by manually turning either of the end caps, wherein the end caps remain outside the bracket and extend to the right and to the left of the bracket when viewing the front view of the T-frame, and the shaft can slide to the right or to the left along its axis through the bracket allowing lateral movement of the string wrapped around the shaft, said lateral movement being limited by the distance between the end caps.

4. The surface cleaning device of claim 3 wherein the bracket comprises a hollow bracket in the shape of a cylinder having two openings at opposite ends and further including a top opening and a bottom opening, the axis of the cylinder being parallel with the axis of the handle, the string running between the first and the second hole in front of the handle enters the top of the hollow bracket through the top opening wraps around the shaft and then exits the bottom of the hollow bracket through the bottom opening on its way to the second hole in the handle adjacent the shoe; the shaft passes through the two openings at the opposite ends of the hollow bracket such that the shaft is perpendicular with the axis of the cylinder, and the two openings allow for rotation and lateral movement of the shaft between the end caps.

5. The surface cleaning device of claim 3 wherein the bracket is formed out of a piece of steel wire such that two identical loops connected by a horizontal section are formed to function as bearings for the shaft and to hold the shaft parallel to the axis of the shoe, the horizontal section connecting the two loops being parallel with the shaft and rests against the front of the handle providing clearance for the shaft and the string wrapped around the shaft; wherein ends of the wire forming the loops are bent toward the handle such that the ends have a common axis perpendicular to the handle; wherein two opposite holes with a common axis parallel to the axis of the shoe are provided in the handle to receive the ends of the wire to hold the bracket and the shaft in place; wherein the string is wrapped around the shaft between the two loops and the end caps remain outside the two loops limiting the lateral movement of the shaft.

* * * * *